United States Patent [19]

Burnop

[11] 4,104,180

[45] Aug. 1, 1978

[54] PRODUCTION OF OVERBASED METAL PHENATES

[75] Inventor: Victor Charles Ernest Burnop, Wantage, England

[73] Assignee: Exxon Research & Engineering Co., Linden, N.J.

[21] Appl. No.: 791,714

[22] Filed: Apr. 28, 1977

Related U.S. Application Data

[63] Continuation-in-part of Ser. No. 687,557, May 18, 1976, abandoned.

[30] Foreign Application Priority Data

May 23, 1975 [GB] United Kingdom ..... 22510/75

[51] Int. Cl.[2] ..... C10M 1/40; C10M 3/34; C10M 5/22; C10M 7/38

[52] U.S. Cl. ..... 252/33; 44/51; 252/42.7

[58] Field of Search ..... 252/33, 42.7; 44/51

[56] References Cited

U.S. PATENT DOCUMENTS

| | | | |
|---|---|---|---|
| 2,616,904 | 11/1952 | Asseff et al. | 252/33 |
| 2,920,105 | 1/1960 | Kluge et al. | 252/33 |
| 3,277,002 | 10/1966 | Hunt et al. | 252/18 |
| 3,746,698 | 7/1973 | Hunt et al. | 252/45 |

*Primary Examiner*—Delbert E. Gantz
*Assistant Examiner*—Irving Vaughn
*Attorney, Agent, or Firm*—Frank T. Johmann

[57] ABSTRACT

Producing overbased carbonates by hydrolyzing a metal alkoxyalkoxide in the presence of a phenolic or sulphonic surfactant and carbonating the product of hydrolysis.

26 Claims, 1 Drawing Figure

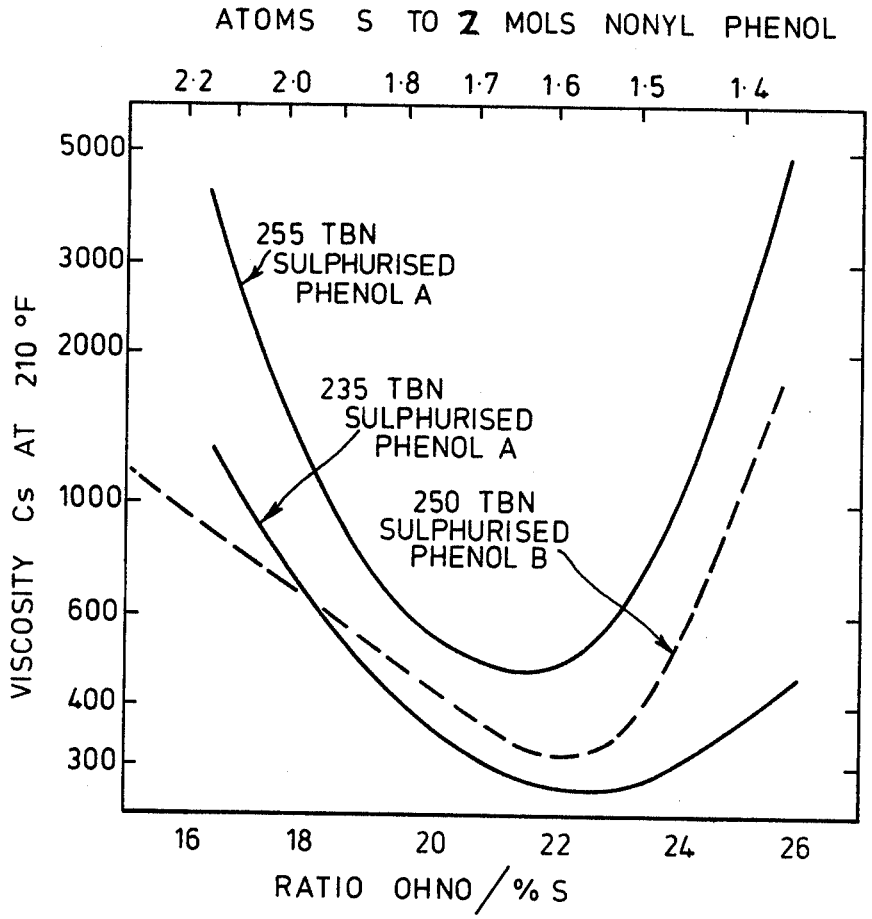
ATOMS S TO 2 MOLS NONYL PHENOL
2·2
2·0
1·8
1·7
1·6
1·5
1·4
5000
3000
2000
1000
600
400
300
VISCOSITY Cs AT 210 °F
255 TBN
SULPHURISED
PHENOL A
235 TBN
SULPHURISED
PHENOL A
250 TBN
SULPHURISED
PHENOL B
16
18
20
22
24
26
RATIO OHNO / % S

PRODUCTION OF OVERBASED METAL PHENATES

This is a continuation-in-part of my prior application Ser. No. 687,557 filed May 18th, 1976, and now abandoned, and the invention relates to a process for making detergent additives of high basicity suitable for use in lubricating oils.

There is an increasing need for detergent additives which have high basicity, and this invention is concerned with high basicity phenates commonly known as overbased phenates particularly overbased magnesium phenates. These compounds have been found to be particularly useful as additives in lubricating oils used in connection with high sulphur containing fuels, such as marine diesel fuels, since the high basicity will neutralise the acids formed by the burning of the fuel.

The use of dispersed overbased alkaline earth metal compounds such as overbased alkaline earth metal phenates and sulphonates as additives in lubricating oils is known. It has been proposed to produce overbased alkaline earth metal carbonates by carbonating a mixture of a magnesium methanolate in the presence of a surfactant such as an alkyl phenol, that may be sulphurised, or an alkylaryl sulphonate. However, one problem associated with this process is that the magnesium methanolate is sparingly soluble in methanol. An alternative process using carbonated metal alkoxy-ethanol complexes as intermediates in the preparation of such overbased additives is known from U.S. Pat. Nos. 3,150,089, 3277,022, 3,718,589, 3,746,698 and 3,775,170 where the dispersed alkaline earth metal is a carbonate. These patents all require the special formation of a carbonated complex of the general formula:

$$M(OCH_2CH_2OR)_{2-x}(O-\overset{\overset{\displaystyle O}{\|}}{C}-OCH_2CH_2OR)_x$$

where M is alkaline earth metal generally calcium or magnesium and x is between 0.5 and 1.5. We have now found that overbased metal compounds particularly overbased magnesium phenates may be obtained by somewhat similar techniques but without the need to specifically prepare the carbonated complex intermediate.

These earlier processes described above require the use of a volatile hydrocarbon solvent which, although not detrimental to product quality decreases the plant capacity and also requires removal and recovery and separation of the solvent at the end of the reaction. Our process not only enables overbased phenates to be prepared both without the need to specifically form the metal complex but in many instances it does not require a volatile hydrocarbon solvent.

A problem associated with the production of overbased metal compounds is that of the viscosity of both the reaction mixture and the final product itself. The overbased materials consist of an alkaline earth metal compound, generally a carbonate, dispersed in the alkaline earth metal salt of the dispersing agent; the amount of dispersed alkaline earth metal being known as the overbased amount. Generally these overbased materials are used as detergents in lubricating oils to react with acid residues formed in the oil thus, the greater the basicity of the material the better since this allows smaller amounts of the materials to be used for a given effect in a certain lubricating oil. However, to increase basicity it is necessary to increase the dispersed alkaline earth metal content which tends to increase the viscosity of the reaction mixture leading to processing problems. This problem is particularly marked if the alkaline earth metal is introduced in the form of the carbonated complex previously described and in order to overcome this problem it may be necessary to increase the amount of solvent used thus reducing reactor capacity and requiring solvent recovery.

We have found that if the metal is introduced as its alkoxide and the carbonate formed after the alkoxide has been mixed with the surfactant and hydrolysed it is possible to obtain highly basic materials consistently without viscosity problems and in many instances without the need for an additional solvent.

According to this invention a colloidal suspension in oil of a metal carbonate is prepared by a process comprising:

(1) forming a reaction mixture comprising:

(a) an alkaline earth metal alkoxyalkoxide together with the alkoxyalcohol (b) a surfactant being a sulphonic acid or metal, preferably Group IIA metal, sulphonate or one or more hydrocarbyl substituted phenols or metal phenates wherein the or each hydrocarbyl group contains up to 60 carbon atoms, or one or more sulphurised phenols having one or more hydrocarbyl group substituent containing up to 60 carbon atoms, or mixtures of said surfactants (c) a non-volatile diluent oil (d) at least one mole of water for every gram atom of the alkaline earth metal present in excess of the amount of the metal required to neutralise the surfactant (2) hydrolysing the alkaline earth metal alkoxyalkoxide (3) introducing carbon dioxide into the reaction mixture under conditions at which the volatiles do not distil from the reaction mixture (4) removing volatiles from the reaction mixture The alkaline earth metal alcoholate may be prepared in situ by reacting a metal oxide or hydroxide with an alkoxy alcohol such as ethoxy ethanol. Alternatively the alcoholate itself may be used as the starting material in which case we prefer to use a solution of the alcoholate in the ether alcohol which is preferably ethoxyethanol. The alkaline earth metal may be calcium, barium, strontium or magnesium, although the techniques of the present invention are particularly useful in the production of overbased magnesium dispersants especially magnesium phenates. The alcoholate may conveniently be prepared by dissolving the metal in the alkoxyalcohol and when we use this technique with our preferred metal magnesium we prefer to use ethoxyethanol since the magnesium ethoxyethoxide is readily soluble in ethoxyethanol.

Where the surfactant is phenolic the or each hydrocarbyl substituent in the hydrocarbyl substituted phenol preferably has at least nine carbon atoms. Although the hydrocarbyl substituent can be alkenyl, alkyl, aryl, aralkyl or alkaryl group, it is preferred that it should be an alkyl group and especially one containing 9 to 15 carbon atoms since compounds in which the alkyl group contains less than 9 carbon atoms have limited solubility in oil. Examples of suitable compounds include nonyl, decyl, dodecyl or tetradecyl phenol. Substituents which could be used include dodecenyl, tetradecenyl and aromatic substituents such as phenyl ethyl and benzyl.

Mixtures of alkyl phenols include for example a mixture of nonyl phenol and dodecyl phenol.

It is preferred that the phenol be substituted with just one hydrocarbyl group, usually in the para position, but if desired there may be more than one hydrocarbyl substituent and mixtures of mono- and di- substituted phenols may be used. We prefer however to use phenols containing at least 90% by weight of monoalkyl phenol.

The hydrocarbyl substituted phenol may have other substituents e.g. halogens such as chlorine or bromine, nitro or sulphonic acid groups.

We have also found that where the products are obtained from sulphurised alkylphenols the sulphur content of the starting material has a bearing on the viscosity of the product for a given TBN. For example, we prefer to use a 70% nonyl phenol sulphide, 30% oil mixture containing from 5.5% to 7.5% by weight of sulphur to obtain a lubricant additive of TBN in the range 230 to 260.

When the main constituent of the surfactant is a sulphurised bridged phenol it will generally be of the general formula:

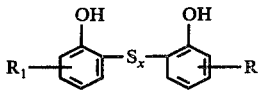

where R and $R_1$ may be the same or different and may represent one or more alkyl groups. Sulphurised alkyl phenols may be obtained as mixtures of derivatives based on mono and di alkyl phenols or predominantly mono alkyl and the process of the present invention is equally applicable to both types of sulphurised alkyl phenol although we find the improved products are generally obtained when using the predominantly mono alkyl phenol. These sulphurised phenols are obtained by reacting the substituted phenol with a sulphur chloride e.g. $SCl_2$ such sulphurised phenols having one or more hydrocarbyl groups as substituents, each substituent having not more than 60 carbon atoms. The preferred sulphurised phenols are of the formula set out above and having one or more hydrocarbyl group containing for example 9 to 15 carbons, per benzene ring, preferably the hydrocarbyl group is in the para position with respect to the hydroxyl group. There may be 1, 2, 3 or 4 sulphur atoms in the bridge linking the two phenyl groups, generally 1 or 2. Sulphurised bridged phenols are usually mixtures and we prefer to use material containing an average from 1.5 to 1.7 sulphur atoms per pair of phenyl groups. When a sulphurised bridged phenol is used we prefer to use a material in which the ratio of hydroxyl number to percentage sulphur is in the range of 19–23 since this tends to yield a product of lower viscosity.

Examples of sulphonates that may be used include the traditional detergents such as $C_{18}$ to $C_{30}$ especially benzene sulphonic acids or sulphonates and other long chain alkyl substituted benzene sulphonic acids, the so-called mahogany sulphonates obtained by extracting crude oil fractions with sulphuric acid may also be used.

The non-volatile diluent oil can be any diluent oil, such as paraffinic or naphthenic hydrocarbon oil, e.g. of mineral origin obtained by conventional refining. Alternatively synthetic lubricating oils, vegetable oils, animal oils or mixtures of such oils may be used. We find that oils which have viscosities of 15 to 30 cS at 100° F are very suitable. As a further alternative one could use a lubricating oil such as those described later in the specification.

As mentioned we prefer that the metal be introduced as a solution of the alcoholate in the alkoxyalcohol, and where the metal is magnesium we prefer that the alkoxyalcohol be ethoxyethanol. In this situation excess alkoxyalcohol will be present which together with alkoxylalcohol liberated by the hydrolysis will act as a solvent for the process of the present invention. We prefer to have from 25% to 50% by weight of excess alkoxylalcohol. The metal alkoxide is hydrolysed to form the metal hydroxide which is converted to the carbonate by the introduction of carbon dioxide. We find that the temperature of the reaction mixture during carbonation is important in the conversion to the carbonate.

We find that if the temperature of the reaction mixture is 120° C or above when the alkoxyalcohol is ethoxyethanol carbonation is less effective with less carbon dioxide being taken up. In some instances the product obtained is less soluble in oil and has increased viscosity at a temperature below that at which the volatiles are distilled from the reaction mixture. The volatiles are water, alkoxyalcohol and any volatile solvent that may be used. The actual temperature at which the volatiles distil off depends upon their nature and the extent to which they interact to form azeotropes and the like. We find for example that where the volatiles are water and ethoxyethanol distillation occurs at around 135° C. However, irrespective of the exact distillation temperature we find that carbonation should be effected at a temperature below that at which the volatiles distil. Although the process of the present invention does not generally require a second solvent of the type described in U.S. Pat. Nos. 3,718,858; 3,746,698 and 3,775,170, the use of such a second solvent is not excluded from the invention. In some instances, particularly in the preparation of materials from the sulphurised phenols with a high sulphur content and where the surfactant is a sulphonic acid or metal sulphonate, a second solvent may be required. When a solvent is used it should be volatile and we prefer to use hydrocarbons such as hexane although chlorinated solvents such as carbon tetrachloride or chlorobenzene may be used.

In practice it is desirable to decide the relative amounts of metal alcoholate and surfactant according to the TBN (total base number) desired for the overbased additive. The amount of ether alcohol in which the alcoholate is dissolved is determined to some extent by the nature of the alcohol, and the amount of oil is governed by the requirement for a workable reaction medium of suitable viscosity as well as its amount in the final product, the finished product typically being about 60 wt.% active matter.

In a reaction mixture the amounts of reactants are as follows:

| | Equivalents |
|---|---|
| Total Surfactant | 1 |
| Metal Alcoholate | 2–5 |

Oil — about 35–40 wt.% of total weight of finished product.

In the production of overbased phenates the total surfactant will consist of the hydrocarbyl substituted phenol or sulphurised phenol, where the metal is magnesium we prefer that the ratio of the number of equivalents of magnesium to the total number of equivalents of surfactant be between 3 and 4 since higher ratios can result in a product of increased viscosity.

The water may then be added to the reaction mixture, preferably in admixture with the ether alcohol from which the metal alcoholate is prepared. If water is added alone there can be a delay in hydrolysis which can cause a gel to be formed and the presence of the ethoxy ethanol is thought to result in better dispersion of the water, we prefer to use a 50:50 mixture. We prefer to use at least 1.4 moles of water for each metal atom present in excess of the number of metal atoms required to react with the phenol. Most preferably we use an amount of water in the range 1.4 moles to 2 moles of water for each excess metal atom. The reaction mixture is preferably heated when the water is present to ensure hydrolysis of the metal alcoholate, temperatures up to 100° C may be employed although the mixture is preferably at a temperature in the range 50° C to 70° C. We prefer to use a temperature of about 60° C since if the temperature during hydrolysis is below about 50° C the reaction mixture tends to become too viscous and can separate into two layers. If however the temperature rises to above 70° C the final product tends to be of high viscosity. Once hydrolysis is complete, carbon dioxide is passed through the product during which the temperature of the reaction mixture increases gradually to about 100° C but we prefer to ensure that the temperature does not rise to above 100° C and certainly not about 120° C since this reduces the uptake of carbon dioxide and tends to produce a product of high viscosity and limited oil solubility. The minimum temperature that should be used for carbonation depends upon the reactants but we have found that the uptake of carbon dioxide is so slow at temperatures below 50° C, particularly in the production of overbased phenates that we prefer to carbonate at above 50° C, preferably above 60° C.

The reaction mixture is preferably carbonated before removal of the volatiles although they may be removed prior to carbonation providing the reaction mixture is cooled before it is carbonated. However in the final step of our preferred process the volatiles consisting mainly of the ether alcohol and a solvent if one is used are removed from the reaction mixture. This can be done by distillation and if necessary blowing with carbon dioxide or an inert gas such as nitrogen. It is preferable to keep the distillation temperature below 150° C to avoid decomposition of the product which can result in unpleasant odours and if a relatively high boiling point ether alcohol has been used in the reaction whose removal is difficult without exceeding the decomposition temperature of the desired product. low pressure distillation may be used.

The preferred product is found to be a colloidal suspension in oil of Group IIA metal basic compounds, mainly carbonate but including basic carbonate, oxide or hydroxide together with Group IIA metal surfactants added as dispersant and when the surfactant is phenol the average diameter of the colloidal particles generally being less than 60 A. Usually the finished product is 50–70% e.g. 60% active ingredients in oil. Its TBN can vary from 150 to 400, usually 200–300, e.g. 240–260. We find tha the process of the present invention allows a higher TBN product (around 250) to be obtained consistently without viscosity problems and without the need for a second solvent although, the use of one is not excluded.

The major constituents of the preferred Group IIA metal sulphurised phenates obtained by our process have the structure:

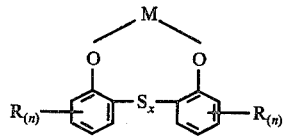

where M is the group IIA metal, R is a hydrocarbyl group. The final product can be a mixture of such phenates where $x$ and $n$ vary for different molecules and minor amounts of compounds in which more than two aromatic rings are joined by sulphur links may be present. However generally $n$ is 1 and/or 2 and $x$ is 1 or 2 and possibly 3 or 4 with an average value of from 1.5 to 2.

As mentioned the process of the present invention does not generally require a second solvent which is particularly advantageous since the absence of the solvent allows more active material to be obtained from a certain size vessel and obviates the need to remove and recover this solvent.

We find the final colloidal suspension in the oil obtained by our process generally contains very little, often less than 0.05% by weight of sediment so that filtration may not be needed.

According to a further embodiment of our invention when the surfactant is phenolic we add a minor amount of a sulphonate or a sulphonic acid to the reaction mixture. We find that in some instances the presence of the sulphonate gives the final product improved solubility in highly viscous oils and also reduces the tendency of the product to form a skin. We believe that the presence of the sulphonate or sulphonic acid helps to stabilise the colloid and we find that best results are obtained if it is added to the initial reaction mixture prior to carbonation and that up to about 6% by weight of sulphonate or sulphonic acid based on the weight of final product is sufficient to achieve the desired effect. Where sulphonate or sulphonic acid is present, reference to total surfactant is to the combined phenolic and sulphonate or sulphonic acid components.

The overbased detergent additives prepared by the process of this invention are very suitable for use in lubricating oils where their detergent properties inhibit formation of undesirable sediments whilst the high TBN of the product neutralises acids which may originate from fuel combustion thus reducing engine corrosion. The lubricating oils can be any animal, vegetable or any of the traditional mineral oils for example petroleum oil to SAE 30, 40 or 50 lubricating oil grades, castor oil, fish oils or oxidised mineral oil.

Alternatively the lubricating oil can be a synthetic ester lubricating oil and these include diesters such as di-octyl adipate, di-octyl sebacate, didecyl azelate, tridecyl adipate, didecyl succinate, didecyl glutarate and mixtures thereof. Alternatively the synthetic ester can be a polyester such as that prepared by reacting polyhydric alcohols such as trimethylolpropane and pentaerythritol with monocarboxylic acids such as butyric acid to give the corresponding tri- and tetra- esters. Also complex esters may be used, such as those formed by esterification reactions between a carboxylic acid, a glycol and an alcohol or a monocarboxylic acid.

The overbased detergent is generally added to the lubricating oil as a concentrate and we find that between 0.01% and 30% by weight, preferably between 0.1% and 5% by weight of a concentrate consisting of 60 wt.% metal carbonate plus metal sulphurised phenate and 40 wt.% oil is particularly useful.

The final lubricating oil composition may if desired contain other additives e.g. a Viscosity Index improver such as an ethylene-propylene copolymer, an overbased calcium sulphonate or a dispersant such as polyisobutylene succinamide.

The present invention is illustrated but in no way limited by reference to the following examples.

In Examples 1 to 5 Sulphurised Nonyl Phenol A was a product made from nonyl phenol containing 35 wt.% of dinonyl phenol diluted with a non-volatile oil to 70% by weight active ingredient. Sulphurised Nonyl Phenol A contained 7.4% by weight of sulphur and had a hydroxyl number of 131.

Sulphurised Nonyl Phenol B was prepared by adding 200 grams of sulphur dichloride to 660 grams of mononnonyl phenol dissolved in hexane followed by vacuum stripping. The product contained 8.7% by weight of sulphur and had a molecular weight of 484.

The magnesium alkoxylalkoxide was prepared by dissolving magnesium metal in about ten times its weight of ethoxyethanol to give a solution containing from 8.8 to 9.0% by weight of magnesium.

EXAMPLE 1

The following mixture was made:

374 grams magnesium alkoxy alkoxide (9.0% Mg), 250 grams sulphurised Nonyl Phenol A, and 250 grams of Naphthenic hydrocarbon diluent oil of viscosity 5cS at 210° F, and stirred at 50° C over a period of 2 hours whilst a second mixture containing 27 grams of water and 27 grams ethoxyethanol was run in. Carbon dioxide was then passed into the resulting product which was maintained at 50° C until 29 grams of carbon dioxide has been absorbed. The addition of carbon was then continued while the temperature was slowly raised to 150° C. The pressure in the reaction vessel was then slowly reduced to about 25 centimeters of mercury and the volatile materials stripped off. The resulting product was found to contain only 0.04% by volume of sediment which was removed by filtration.

The final product had a TBN of 250 and a viscosity of 529 centistokes at 210° F and performed well as an additive in lubricating oils.

EXAMPLE 2

The process of Example 1 was repeated with 220 grams of sulphurised nonyl phenol B and 280 grams of the diluent oil. The mixture was hydrolysed with a mixture of 36 grams of water and 36 grams of ethoxyethanol and 43 grams of carbon dioxide were absorbed before stripping. The final product weighed 609 grams before filtering, had a TBN of 254 and a viscosity of 427 centistokes at 210° F.

EXAMPLE 3

Example 1 was repeated except that 300 grams of sulphurised nonyl phenol A were used, the amount of diluent was reduced to 200 grams and the carbon dioxide charge increased to 44 grams. The total base number of the product was 249 and the viscosity at 210° F was 753 centistokes.

EXAMPLE 4

The process of Example 3 was repeated using only 18 grams of water. The product obtained had a TBN of 248 but formed a skin upon exposure to air and could not be poured.

EXAMPLE 5

An overbased sulphurised magnesium phenate was prepared in a 40 gallon reactor by charging 60 kilogrammes of the magnesium alkoxyalkoxide, 32.3 kilogrammes of the naphthenic hydrocarbon oil and 48.4 kilogrammes of the sulphurised nonyl phenol A into the reactor. The mixture was stirred at 60° C and hydrolysed by adding 8.6 kilogrammes of a 50% by weight mixture of water and ethoxyethanol evenly over a period of 2 hours. The mixture was then stirred for a further two hours and the reactor heater then turned off. Carbon dioxide was passed into the bottom of the reactor at the rate of 30 liters per minute and the amount of unabsorbed carbon dioxide was measured by weighing a caustic soda trap attached to the exit from the reactor.

The reaction temperature and $CO_2$ absorbed by the reaction mixture was as follows:

| Hours of $CO_2$ Introduction | Kilograms $CO_2$ absorbed | Reaction Temperature ° C |
|---|---|---|
| 0 | 0 | 60 |
| ½ | 1.8 | 69 |
| 1 | 3.6 | 75 |
| 1½ | 4.9 | 79 |
| 2 | 6.0 | 80 |
| 3 | 6.1 | 79 |
| 4 | 6.4 | 77 |

The rate of introduction of carbon dioxide was then reduced to 10 liters/minute, the temperature raised to 150° C and the pressure in the vessel reduced to 60 millimeters of mercury to remove volatile materials.

The product was found to contain 0.04% by volume of sediment which was completely removed by adding 250 grams of Dicalite Special Speed flow filter aid and then filtering through a plate and frame filter.

The yield of filtered material was 94.6 kilogrammes of colloidal dispersion in oil having a sediment less than 0.01% with a TBN of 236 and a viscosity of 321 centistokes at 210° F.

The products of all the above Examples were found to perform well as dispersants and neutralizing agents in lubricating oils.

EXAMPLE 6

The following ingredients were charged to a 40 gallon reaction vessel:

(i) 65 kilogrammes of a solution of magnesium ethoxyethoxide in ethoxyethanol containing 8.75 wt.% magnesium (ii) 43.6 kilogrammes of sulphurised mononnonyl phenol having a hydroxyl number of 178 and containing 7.7 wt.% sulphur (iii) 3.3 kilogrammes of $C_{24}$ alkyl benzene sulphonic acid (iv) 32.4 kilogrammes of a paraffinic diluent oil The mixture was heated to 60° C and 11.4 kilogrammes of a 50 wt.% water and ethoxyethanol mixture were then run into the reactor over a period of 1 hour.

Carbon dioxide was next passed into the reactor for a period of 4 hours at a rate of 20 liters per minute whilst the temperature was allowed to increase by 10° C per hour. Absorption of carbon dioxide was complete after 4 hours and the rate of introduction was then reduced to 10 liters per minute and the temperature raised to 150° C and the pressure reduced to 30 millimeters of mercury. 59.4 kilogrammes of ethoxyethanol containing 1% by weight of water were distilled off.

After centrifugation for 30 minutes in white spirit the product had a sediment of 0.08 wt.% and after addition of 250 grams of filter aid and then filtering and washing the reactor with 5.0 kilogrammes of diluent oil the combined weight of filtrate and washing was 99 kilogrammes. The product had zero sediment, a TBN of 252 and a viscosity at 210° F of 240 centistokes.

The product contained:

5.5 wt.% magnesium,
3.44 wt.% sulphur, and
0.26 wt.% chlorine.

EXAMPLE 7

1500 grams of nonyl phenol (65 wt.% mononnonyl phenol and 35 wt.% dinonyl phenol) having a hydroxy number of 216 were mixed in a reaction vessel with 606 grams of a hydrofined paraffinic oil of viscosity 4cS at 210° F at a temperature between 80° C and 90° C. 430 grams of a mixture containing 60% $SCl_2$ and 40% $S_2Cl_2$ were then added over a period of 4 hours after which the product was blown with nitrogen at 100° C over a period of 8 hours to remove hydrochloric acid.

2300 grams of a product were obtained which had a hydroxyl number of 138 and contained 6.87 wt.% sulphur and 0.25 wt.% chlorine.

2100 grams of this product were mixed with 1260 grams of a paraffinic diluent oil having a viscosity of 4cS at 210° C, 140 grams of of an 88% active ingredient oil solution of a $C_{24}$ alkylbenzene sulphonic acid and a magnesium alkoxy alkoxide prepared by dissolving 240 grams of magnesium in 2400 grams of ethoxyethanol. This mixture was stirred vigorously at 60° C whilst 380 grams of a 50 wt.% water-ethoxyethanol mixture was run in over a period of 2 hours. The product was then saturated with carbon dioxide at a temperature between 60° C and 80° C, 258 grams of carbon dioxide being absorbed. After stripping, 4350 grams of material of TBN 251 and having a viscosity at 210° F of 502 centistokes was obtained. When the product was diluted with more diluent oil to have a TBN of 241 the viscosity at 210° F reduced to 333 centistokes.

EXAMPLE 8

52 kilogrammes of the sulphurised nonyl phenol A containing 35 wt.% dinonyl phenol and 65 wt.% mononnonyl phenol and 6.7 wt.% sulphur having a hydroxyl number of 121 were charged to a reaction vessel together with 62 kilogrammes of a solution of magnesium ethoxyethoxide containing 8.7 wt.% magnesium and 31.3 kilogrammes of a diluent oil viscosity of 4cS at 210° F. The mixture was stirred at 60° C and 8.4 kilogrammes of a 50% by wt. mixture of water and ethoxyethanol added over a period of 2 hours.

Carbon dioxide was then passed into the reaction vessel at the rate of 20 liters per minute for a period of 4 hours during which the temperature was allowed to rise to 80° C and 6.2 kilogrammes of carbon dioxide were absorbed. When there was no further absorption of carbon dioxide, the rate at which it was introduced was reduced to 10 liters per minute and the temperature slowly raised to 150° C; when the temperature reached 120° C the pressure was gradually reduced until ethoxyethanol started to distil and this was allowed to continue until there was no further distillation of ethoxy ethanol.

The product which contained 0.05% sediment had a TBN of 242 and a viscosity of 372 centistokes at 210° F.

EXAMPLE 9

986 parts of 70% active ingredient sulphurised mononnonyl phenol of hydroxyl number 156 containing from 6.6 to 7.0 wt.% sulphur, 664 parts of diluent oil and 58 parts of a $C_{24}$ alkyl benzene sulphonic acid were added to a solution of 115 parts of magnesium in 1150 parts of ethoxyethanol held at 60° C. 120 parts of water in 260 parts of ethoxyethanol were then added slowly to this mixture which was held at 65° C. The mixture was then carbonated with carbon dioxide and when 140 parts of carbon dioxide had been absorbed the temperature was raised to 150° C and the pressure reduced to 50 millimeters of mercury so that the ethoxyethanol distilled off.

Upon filtration a product was obtained that had a TBN of 259 and a viscosity of 252 centistokes at 210° F.

EXAMPLE 10

1225 parts of 70% active ingredient dodecyl phenol sulphide of hydroxyl number 133 containing 7.2 wt.% sulphur, 728 parts of diluent oil and 65 parts of $C_{24}$ alkyl benzene sulphonic acid were added to 144 parts of magnesium dissolved in 1444 parts of ethoxyethanol held at 60° C. 144 parts of water mixed with 432 parts of ethoxyethanol were added slowly to the original mixture which was then at 65° C.

After the addition of the water/ethoxyethanol mixture carbon dioxide was passed into the reaction vessel whose temperature was held at 65° C until 137 parts of carbon dioxide had been absorbed. The introduction of carbon dioxide was continued whilst the product was stripped to 150° C and 50 millimeters mercury pressure.

Upon filtration a product was obtained that had a TBN of 242 and a viscosity of 391 centistokes at 210° F. Analysis of the product showed:

5.3% magnesium
3.8% sulphur

EXAMPLE 11

The products of Examples 8, 9 and 10 were included in lubricating oils based on a MIL-C lubricating oil and containing, 3.7 wt.% of an ashless polyamine dispersant and 1.2% by weight of neutral calcium phenate, 1.2 wt.% of a zinc dialkyldithiophosphate and 1.2 wt.% of magnesium sulphonate.

These oils were subject to the following tests to determine their suitability as lubricating oils:

(i) The MS IIC anti-rust test (ASTM STP 315 F)

(ii) The L38 bearing corrosion test (SAE publication 680538)

(iii) The Modified Catalysed Oxidation test (Mod COT) in which an oil sample containing 0.1 wt.% iron naphthenate is stirred into a paddle made from a Petter W-1 engine bearing with air blowing at 171° C and the % increase in the viscosity of the oil after 30 and 48 hours is measured.

(iv) Differential Scanning Calorimeter (DSC) in which an oil sample is heated in an aluminum plan in air at 210° C and 100 psi pressure. After a certain length of time (the induction time) the oil oxidises and the heat of oxidation is measured. The induction time and the heat of oxidation are then combined according to the following formula:

$$\angle = 1.5188 \log_{10} G - 0.3167 \log_{10} F$$

where

G = induction period in minutes

F — heat of oxidation in calories per gram.m to give the "∠" value which gives an indication of the oxidation stability of the oil. The lower the ∠ value the greater the oxidation stability.

The results of these tests are as follow:

| Magnesium Phenate | Wt.% | MSIIC Value | BWL Mg. | Mod COT Visc. Increase% 30H | 48H | DSC ∠ Value |
|---|---|---|---|---|---|---|
| Example 7 | 2.5 | — | 26.0 | — | — | — |
| Example 8 | 1.5 | — | 65.5 | 110 | 390 | 0.6 |
| Example 8 | 2.5 | 8.1 | 59.5 | 120 | 550 | 1.0 |
| Example 9 | 1.5 | — | 28.0 | 140 | — | 1.0 |
| Example 9 | 2.5 | 7.6 | 25.0 | 230 | — | 1.0 |
| Example 10 | 1.5 | — | 44.3 | 170 | 780 | 0.8 |
| Example 10 | 2.5 | 8.5 | 4.55 | 170 | 670 | 0.6 |

EXAMPLE 12

Sulphurised decyl phenol was prepared by reacting 360 grams of decyl phenol with 122 grams of sulphur dichloride dissolved in 75 ml of a solvent (the sulphur dichloride was 90% $SCl_2$ and 10% $S_2Cl_2$ and contained 32.7% by weight of sulphur). The decyl phenol was heated to 50° C with 150 ml of solvent and the sulphur dichloride added over a period of 2 hours during which the temperature rose to 65° C. The reaction mixture was stirred for 30 minutes and then stripped at 130° C under a pressure of 130 millimeters mercury. The product was then diluted with oil to 70 wt.% active ingredient to yield 570 grams of material having a hydroxyl number of 154 and containing 6.98 wt.% sulphur and 0.33 wt.% chlorine.

222 grams of this 70 wt.% active ingredient decyl phenol sulphide were mixed with 95.2 grams of a hydrofined paraffinic oil of viscosity 4 centistokes at 210° F and 256.6 grams of a solution of magnesium ethoxyethoxide in ethoxyethanol containing 8.68 wt.% magnesium. The mixture was initially heated to 60° C and the temperature then allowed to rise to 70° C whereupon 45.4 grams of a 50:50 mixture of water and ethoxyethanol was added over a period of half an hour. The mixture was then carbonated by passing carbon dioxide through the mixture at the rate of 120 ccs per minute until, after 3¼ hours no further carbon dioxide was absorbed.

The material was then stripped at 150° C and 100 millimeters mercury to give 245 grams of a product of TBN 254 and a viscosity of 456 centistokes at 210° F. The product was readily soluble in mineral oil giving a clear solution at concentrations up to 5% by weight in the oil.

EXAMPLE 13

A mixture of:

(1) 190 grams of magnesium ethoxyethoxide in ethoxyethanol containing 9.0 wt.% of magnesium.

(2) 124 grams of a branched chain $C_{24}$ alkyl benzene sulphonic acid.

(3) 125 ml of a 50:50 by weight mixture of refined paraffinic and naphthenic mineral oils of viscosity 5 centistokes at 210° F.

(4) 100 ml of hexane. Was stirred at 60° C and 38 grams of a 50:50 by weight mixture of water and ethoxyethanol added over a period of 1 hour. The mixture was then heated to 75° C and then saturated with carbon dioxide. Volatiles were stripped off at 150° C whilst blowing with carbon dioxide and finally reducing the pressure to ⅓ atmosphere. After filtration 310 grams of a product having a TBN of 232 and a viscosity of 450 centistokes at 210° F was obtained.

EXAMPLE 14

The process of Example 13 was repeated using 245 grams of the solution of magnesium ethoxyethoxide and 50 grams of the 50:50 water, ethoxyethanol mixture. The product had a TBN of 285 and a viscosity of 950 centistokes at 210° F.

EXAMPLE 15

The process of Example 1 was repeated using samples of sulphurised nonyl phenol A and sulphurised nonyl phenol B having different ratios of hydroxyl number to weight percent sulphur. 3 series of preparations were carried out, two with sulphurised nonyl phenol A to TBN's of 255 and 235 and one with sulphurised nonyl phenol B to a TBN of 250.

The viscosities of the products obtained were measured and are shown in the curve which appears as FIG. 1 of this application.

EXAMPLE 16

Two batches of the following mixture:

275 grams magnesium alkoxyalkoxide (9.1% magnesium)

238 grams of a sulphurised nonyl phenol similar to sulphurised nonyl phenol A but containing 6.8 wt.% sulphur and having a hydroxyl number of 142

1.35 grams of a $C_{24}$ alkyl benzene sulphonic acid 67.0 grams of a paraffinic diluent oil were made and hydrolysed at between 60° and 70° C by adding 74 grams of a 50 wt.% water and ethoxyethanol mixture over 1 hour.

The first batch was carbonated for 3 hours at 100° C after which the volatiles were stripped off by passing further carbon dioxide at 150° C and 399 grams of a product having a TBN of 284 and a viscosity of 682 centistokes at 210° F were obtained.

The second batch was also carbonated for 3 hours at 120° C (the boiling point of the water/ethoxyethanol mixture present) after which the remaining volatiles were stripped off by passing further carbon dioxide at 150° C. In this instance 385 grams of a product having a TBN of 293 and a viscosity of 1202 centistokes at 210° F were obtained.

EXAMPLE 17

The process of Example 16 involving initial carbonation at 120° C was repeated using sulphurised nonyl phenol B and in this instance the product could not be filtered due to the presence of large amounts of sediment and was unacceptably viscous.

I claim:

1. A process for preparing an oil soluble overbased metal additive, useful as a lubricating oil detergent and having a total base number of about 150 to 400, comprising the following steps:

(i) forming a reaction mixture comprising:

(a) an alkaline earth metal alkoxyalkoxide together with alkoxyalcohol to serve as solvent, (b) a surfactant selected from the group consisting of $C_{18}$ to $C_{30}$ sulphonic acid, metal sulphonate of said sulphonic acid, hydrocarbyl substituted phenols, metal phenates and sulphurised phenols, having one or more hydrocarbyl group substituents each substituent containing at least 9 and up to 60 carbon atoms, or mixtures of said surfactants with each other, (c) a non-volatile diluent oil, and (d) at least one mole of water for every gram atom of the alkaline earth metal present in excess of the amount of the metal required to neutralise the surfactant, (ii) hydrolysing the alkaline earth metal alkoxyalkoxide by heating the mixture to a temperature from 50° to 100° C., (iii) introducing carbon dioxide into the reaction mixture at a temperature below about 100° C. to thereby form said overbased metal phenates, and (iv) removing volatiles from the reaction mixture, and wherein there are about 2 to 5 equivalents of metal alcoholate per equivalent of surfactant.

2. A process according to claim 1 in which the alkaline earth metal alkoxide is prepared in situ by reacting a metal, a metal oxide or hydroxide with an alkoxy alcohol.

3. A process according to claim 1 in which the alkoxyalcohol is ethoxyethanol.

4. A process according to claim 1 in which the alkaline earth metal is magnesium.

5. A process according to claim 4 in which from 2 to 5 equivalents of magnesium alkoxyalkoxide are used per total equivalent of surfactant.

6. A process according to claim 5 in which between 3 and 4 equivalents of magnesium alkoxyalkoxide are used per total equivalent of surfactant.

7. A process according to claim 1 in which the surfactant is phenolic and the or each hydrocarbyl substituent in the hydrocarbyl substituted phenol has at least nine carbon atoms.

8. A process according to claim 7 in which the or each hydrocarbyl substituent has from 9 to 15 carbon atoms.

9. A process according to claim 7 in which the phenol is a sulphurised phenol the main constituent being of the general formula:

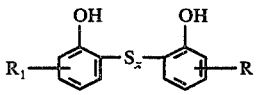

where $R_1$ and R are the same or different and represent one or more alkyl groups and $x$ has an average value from 1 to 2.

10. A process according to claim 9 in which the sulphurised phenol contains at least 90% by weight of material in which $R_1$ and R represent one alkyl group.

11. A process according to claim 9 in which $R_1$ and R are both nonyl groups and the sulphurised phenol contains from 7.5% to 11.0% by weight of sulphur.

12. A process according to claim 9 in which the ratio of hydroxyl number to weight percent of sulphur in the sulphurised phenol is from 19 to 23.

13. A process according to claim 7 in which up to 6% by weight of a sulphonate or sulphonic acid is added to the reaction mixture.

14. A process according to claim 1 in which the surfactant is a $C_{18}$ to $C_{30}$ alkyl benzene sulphonic acid or sulphonate.

15. A process according to claim 1 in which there is from 25% to 50% by weight excess alkoxyalcohol present above that required to dissolve the alkaline earth metal alkoxyalkoxide.

16. A process according to claim 1 in which the water is added to the mixture of the solution of the alkaline earth metal alkoxyalkoxide and the surfactant.

17. A process according to claim 16 in which the water is added in admixture with the alkoxy alcohol.

18. A process according to claim 1 in which at least 1.4 moles of water are used for each metal atom present in excess of the number of metal atoms required to react with the phenol.

19. A process according to claim 1 in which the reaction mixture is at a temperature in the range 50° to 70° C during the hydrolysis.

20. A process according to claim 1 in which the temperature is maintained below 100° C until the reaction mixture is saturated with carbon dioxide.

21. A process according to claim 1 in which carbon dioxide is introduced into the reaction mixture at a temperature above 50° C.

22. Detergent additives of high basicity suitable for incorporating in lubricating oils whenever prepared by a process according to claim 1.

23. Detergent additives according to claim 22 in which the surfactant is phenolic.

24. Detergent additives according to claim 22 in which the surfactant is a sulphurised phenol.

25. Detergent additives according to claim 22 in which the metal is magnesium.

26. A lubricating oil containing from 0.01 to 30% by weight of a detergent additive according to claim 22.

* * * * *